United States Patent [19]

Terry

[11] 3,948,320

[45] Apr. 6, 1976

[54] METHOD OF IN SITU GASIFICATION, COOLING AND LIQUEFACTION OF A SUBSURFACE COAL FORMATION

[75] Inventor: Ruel C. Terry, Denver, Colo.

[73] Assignee: In Situ Technology, Inc., Denver, Colo.

[22] Filed: Mar. 14, 1975

[21] Appl. No.: 558,423

[52] U.S. Cl. ..... 166/272; 166/302; 166/303

[51] Int. Cl.[2] ..... E21B 43/24

[58] Field of Search ..... 166/271, 274, 272, 302, 166/305 R, 307, 303; 299/3, 4, 5

[56] References Cited

UNITED STATES PATENTS

| | | | |
|---|---|---|---|
| 1,532,826 | 4/1925 | Lessing | 299/5 |
| 2,595,979 | 5/1952 | Pevere et al. | 299/5 X |
| 2,919,909 | 1/1960 | Rule | 299/4 |
| 3,770,398 | 11/1973 | Abraham et al. | 299/3 X |

*Primary Examiner*—Stephen J. Novosad
*Assistant Examiner*—George A. Suckfield
*Attorney, Agent, or Firm*—Burton, Crandell & Polumbus

[57] ABSTRACT

A method of liquefying a coal formation in situ wherein the coal formation has been preheated as by a coal gasification project, includes the steps of establishing injection and removal passages connecting the coal formation to the surface, injecting water having a temperature below the formation temperature into the formation to gradually lower the temperature of the formation while forming synthesis gas, injecting a solvent material, having the capability of dissolving the coal, into the formation after it has been reduced to the desired temperature, injecting synthesis gas into the formation to hydrogenate the coal, allowing the formation to subside as the coal is dissolved therein so that more surface area of coal is exposed to the solvent, and removing the admixture of coal and solvent material from the formation as a synthetic crude oil.

11 Claims, 5 Drawing Figures

METHOD OF IN SITU GASIFICATION, COOLING AND LIQUEFACTION OF A SUBSURFACE COAL FORMATION

BACKGROUND OF THE INVENTION

The present invention relates generally to the recovery of subsurface coal and more particularly to a method of in situ liquefaction of a subsurface coal formation.

For more than a hundred years, crude oil and natural gas have become increasingly more important sources of energy for the civilized world. Petroleum products have been available in copious quantities and at prices so low as to capture markets long dominated by coal and other sources of energy. The rising demand for petroleum products has advanced so rapidly that the world wide petroleum industry has been hard pressed to obtain new discoveries of sufficient magnitude to avoid being overtaken by demand. Consequently, proven reserves of petroleum as measured by the number of years of future supplies, have been declining for several years. Further, new discoveries of petroleum reserves in recent years have tended to be located at great distances from population centers, thus compounding the problems of logistics and international politics.

Petroleum has a number of attractive advantages compared to other sources of energy. First, it has a high heat content, approximately six million BTU per barrel in the form of crude oil, and one thousand BTU per cubic foot in the form of natural gas. Second, it is fluid and as such may be produced continuously, transported continuously, and used as a feedstream continuously. Third, petroleum is readily separated into numerous useful products such as gasoline, lubricants, fuel oil and the like. Convenience of use, minimum residues, clean handling and the like are other favorable attributes of petroleum.

Industrialized nations have become highly dependent upon petroleum as a source of energy. The United States, for example, currently depends upon oil and natural gas for about 78% of its energy requirements, while coal supplies are about 18% hydroelectric power about 4%, and nuclear energy less than 1%.

It is unfortunate that the petroleum industry in the United States no longer can expand rapidly enough to keep ahead of the demand for its products at competitive prices. This problem is compounded by the staggering investment and facilities that consume petroleum as a source of energy, such as aircraft, automobiles, locomotives, electric generating plants, furnaces for homes and industries, and the like.

It is obvious that alternate sources of energy must be developed at a pace compatible with the short fall of petroleum. A review of the varied energy consuming devices designed for use of petroleum energy clearly shows that some devices, for example aircraft and automobiles, do not lend themselves to redesign for use of alternate sources of energy. Other devices such as home heating units are so voluminous in number and semipermanent in nature, to make conversion impractical. Other energy consuming facilities such as electric generating plants and industrial boiler plants lend themselves more readily to conversion for use of alternate fuels.

In the ideal case, alternates to petroleum (1) would have the same physical and chemical characteristics as the products replaced, (2) would be derived from a raw material in abundant supply, for example coal, and (3) would be delivered to points of use at a cost competitive with petroleum. Thus, natural gas would be replaced with synthetic natural gas, which in turn would be composed principally of methane ($CH_4$), and crude oil would be raplaced with synthetic crude oil, which in turn would be composed of an array of hydrocarbons. Technology is currently available to produce synthetic natural gas and synthetic crude from coal but unfortunately, except for very special and limited applications, the resultant synthetics are not competitive with petroleum in terms of cost at the point of use.

For a synthetic fuel to be competitive with a natural fuel in a free market, each step in the evolution of the synthetic fuel, on an average must be competitive with each step in the evolution of the natural fuel. In the first step of production, petroleum is delivered as a fluid to the surface by (1) differential pressure from natural reservoir pressure, (2) induced pressure from the surface to the reservoir, or (3) by artificial lift, such as pumps. It is highly desirable that coal be produced in a comparable manner. To do so requires both gasification and liquefaction of coal in situ, in contrast to most current technology which gasifies and liquefies coal above ground after coal has been mined in the conventional manner.

In any attempt to create synthetic crude oil from coal, the first obstacle to be overcome is the hydrogen deficiency of coal as compared to petroleum. While crude oils vary widely in physical characteristics from oil field to oil field, all crude oils contain approximately 10% hydrogen ($H_2$) by weight. Coals, also vary widely in physical characteristics from deposit to deposit, but the hydrogen content in each bituminous coal deposit approximates 5% by weight, with anthracite deposits containing even lower percentages of hydrogen, on a moisture and ash free basis. Liquefying coal, then, is not enough, because it must also be hydrogenated so that coal as a liquid contains hydrogen in quantities approaching that of crude oil. It will be appreciated that it is highly desirable to hydrogenate the coal in situ so that it may be pumped to the surface as a true synthetic crude oil even though, to date, coal has not even been liquefied in situ on a reliable commercial basis. It should be further realized in the in situ production of synthetic crude oil, that just as natural crude oil often has to be cleaned at the surface, i.e., dewatered and desanded, synthetic crude oil from coal will also often have to be cleaned, i.e., deashed.

While most prior art liquefaction of coal has been performed with elaborate equipment above ground, some prior art is directed toward liquefaction of coal in situ, see for example U.S. Pat. No. 2,595,979 of Pevere et al. It is well known in the art, whether attempts be made to practice it above ground or underground, that the hydrogen deficiency of coal must be corrected by the addition of hydrogen from an outside source. Processes to add hydrogen are numerous and heretofore have enjoyed the most successes, from an engineering point of view, in the controlled confines of above ground pressure vessels. Various schemes have been advanced to hydrogenate coal in situ. All have been, at best, marginal from a technical point of view and complete failures from a commercial point of view.

There are serious problems underground to be overcome before any scheme of hydrogenation will work. One of the more serious problems is that of bringing the coal in situ up to reaction temperature. The massive coal deposit is quite frigid compared to the temperature required for hydrogenation reactions at commercially acceptable reaction rates. Numerous schemes have been proposed to raise the temperature of the underground coal. One scheme proposes the placing of electric heaters underground. The number of electric heaters required and the electric power required to bring the coal deposit up to temperature are quite disproportionate to any expected benefits that might accrue. Another scheme proposes injection of superheated vapors into the coal stratum so that, upon condensation of the vapors into liquid, heat will be added through the latent heat of condensation. This results in insignificant additions of heat in hairline cracks or narrow fractures and to localized hot spots in the wider fractures. Still another scheme proposes heating the coal formation by using the heat from the exothermic reaction of hydrogenation itself. If this scheme could be initiated, it would soon be reduced to ineffectiveness due to the enormous volume of cool coal that serves as a heat sink. Still another scheme proposes very high pressures to generate heat. At best an underground coal deposit tends to be a leaky pressure vessel, and with very high pressures the leaks are accentuated, including the possibilities of blow-outs all the way to the surface.

It is virtually imperative that the total coal deposit area to be liquefied be raised to a temperature conducive to hydrogenation and liquefaction and to applicants's knowledge this has not been satisfactorily accomplished in prior art attempts at in situ hydrogenation and liquefaction.

OBJECTS OF THE INVENTION

It is an object of the present invention to provide a new and improved method for removing coal from a subsurface coal formation.

It is another object of the present invention to provide a new and improved method for in situ liquefaction of coal.

It is another object of the present invention to provide a new and improved method for making a synthetic crude petroleum through in situ liquefaction of a coal formation.

It is another object of the present invention to provide a new and improved method for recovering coal from a subsurface coal formation which remains after a coal gasification project has been terminated.

It is another object of the present invention to provide a new and improved method of recovering coal by a liquefaction process from a hot coal bed which remains after an in situ coal gasification project.

It is still another object of the present invention to provide a new and improved method of treating an underground coal formation to convert the coal into other forms of useful energy sources which includes the steps of in situ gasification of the coal, cooling the gasified coal formation to prevent a runaway burn, and liquefying the coal remaining after the gasification and cooling.

SUMMARY OF THE INVENTION

By way of example only, the description of the present invention will be made by reference to a subsurface bituminous coal formation such as found in the western part of the United States, although the process as taught herein may also be used with coals of higher or lower rank. For purposes of description, it is presumed that a coal deposit being liquefied in accordance with the present invention is situated several hundred feet below the surface so that the deposit may be pressurized, for example in the range of 400 to 500 psig, without danger of blowouts to the surface. Preferably, the deposit has undergone gasification using one or more of the processes taught in my copending applications Ser. No. 510,409 and 531,453. When gasification has consumed a substantial portion of the coal in place, for example 50%, the project can be converted to coal liquefaction as described herein. It is interesting to note that when 50% of a coal formation has been extracted using conventional underground mining techniques, the mine would be approaching abandonment because it is not safe to have manpower underground when additional coal is removed, resulting in the weakening of roof support.

It will be appreciated from the description hereinafter and from the disclosures in my aforementioned pending applications, that gases produced during gasification of coal contain coal solvents which may be selectively extracted at the surface and stored for use when the liquefaction process of the invention is to be undertaken.

As a preliminary to a summary of the liquefaction process, it is helpful to understand basically what has happened in the coal formation during a gasification project which preferably preceded the liquefaction. During the process of gasification of coal in situ, exposed surfaces of coal are brought up to ignition temperature and are ignited in the presence of oxygen. A continuing supply of oxygen fosters continued burning of the coal, with surface temperatures in a combustion zone approximately 3000° F. Transfer of heat into the unburned coal proceeds at a very slow rate, since coal is a much better insulator that a conductor of heat. In the early stages of in situ combustion, it is obvious that there are substantial temperature differentials underground. At the onset of underground burning, coal surfaces on fire will have temperatures of about 3000° F while unaffected coal a few inches deeper into the deposit may be as cool as 70° F. Such temperature extremes causes expansion of the coal in place, cracking of the coal nearest the fire, resultant exposure of more surface area to be consumed, release of moisture from the heated coal and the resultant flashing to steam, and oozing of the oils and tars which are subsequently consumed in the fire or are thermally cracked into gases. The noncombustible portion of coal, commonly called ash or mineral matter, varies in content from coal deposit to coal deposit, and may vary within a single deposit. At low and intermediate temperatures, for example, below 1750° F, the noncombustibles generally are dry. As temperatures increase, the ash becomes tacky with tendencies toward agglomeration, and at high temperatures, for example 2800° F., generally becomes free flowing molten slag.

In processes of burning or gasifying coal underground, the products of combustion are hot gases with low specific gravities, and therefore tend to rise to the highest permeable points underground. Molten slag, on the other hand, tends to sink to the lowest permeable point, become cooler and more tacky, and finally immobile. It is for these reasons that more coal is consumed or affected at or near the top of the deposit than at the bottom of the deposit. As the fire proceeds underground during gasification under the influence of injected oxygen, burn paths follow channels of permeability gradually enlarging the channels. After several months of in situ combustion, the burned pattern in plan view resembles the mud cracks of a dry lake with numerous columns of unburned coal extending from the bottom of the coal formation to the undersurface of the overburden or overlying rock formation. These columns provide structural strength to support the overburden. As burning proceeds, the channels become wider and the columns become smaller in cross section. In time, the upper portion of the column can become devoid of volatile matter and in effect become composed of coke or semi coke (commonly called char) while the bottom portion of the column contains an outer crust of coke or semi coke with an inner core of coal that has been largely unaffected except for an increase in temperature and losses of moisture content.

If the in situ combustion of coal has been carried out for the primary purpose of generating fuel gas, a substantial amount of water will have been consumed as a source of hydrogen and oxygen. Synthetic fuel gases from coal in the low to intermediate BTU range contain 55% to 75% more hydrogen than the coal originally contained. High BTU fuel gas (methane) contains approximately 180% more hydrogen than the coal from which it was produced. To provide the required additional hydrogen, water is added to the reaction zone. If the reaction zone temperature is above 1650° F and water is added in liquid form, the reaction is:

$$C + H_2O = H_2 + CO - 71{,}000 \text{ BTU below } 1650° \text{ F}$$

the reaction predominantly is:

$$C + 2H_2O = 2H_2 + CO_2 - 72{,}000 \text{ BTU}$$

Both reactions absorb heat, and gradually reduce the temperature of the residual coal in place. Continuing additions of water will reduce the temperature of the residual coal until at about 800° F the steam no longer takes part in the reaction, a useful temperature marker for the invention described herein. Further, by cooling the formation to a temperature below the ignition point for coal, the possibility of a runaway burn underground is eliminated.

During the cool down phase to bring the residual coal (that coal remaining after gasification has been terminated) down to a temperature of approximately 800° f, substantial quantities of char are F, in the production of synthesis gas ($H_2$ + CO) and hydrogen plus carbon dioxide. Produced gases have useful calorific content in the intermediate to low BTU range and are removed to the surface for commerical use. Maximum hydrogen content occurs at about 1350° F, slowly decreasing with decreasing reaction temperatures until virtually no hydrogen is produced at approximately 800° F. As a practical matter, at about 1000° F the produced gas, principally steam, may be diverted to an adjacent primary in situ gasification area to enhance operations there. Since much of the char is consumed during the cool down phase, the residual coal underground is prepared and ready for liquefaction and hydrogenation into synthetic crude oil in accordance with the method of the present invention.

In the actual liquefaction process, a liquid solvent material having the capability of dissolving the coal in place is injected into the formation at a preselected pressure while the formation is at the temperature remaining after the cool down phase. The desired temperature of the formation is also preselected as an optimum temperature for liquefying the coal. The liquid solvent is preferably a hydrogen donor material to hydrogenate the coal so that a higher heat content product will result from the liquefaction process. To assist in the hydrogenation, a synthesis gas, such as that produced during the cooling down phase, may also be injected into the formation to add hydrogen to the formation.

As the coal is being dissolved by the solvent material, the columns of coal are slowly eaten away so that they are no longer capable of adequately supporting the overburden whereby the overburden is allowed to settle with subsidence of the coal formation. The subsidence of the coal formation breaks the remaining coal into smaller pieces thus increasing the surface area on whch the solvent material can act thereby facilitating the liquefaction of the coal. The liquefied coal is removed from the subsurface coal formation in the form of a free flowing synthetic crude oil and can be refined similarly to the crude oil produced in the petroleum industry for desired end products.

DESCRIPTION OF THE PREFERRED EMBODIMENT

Figure 1:
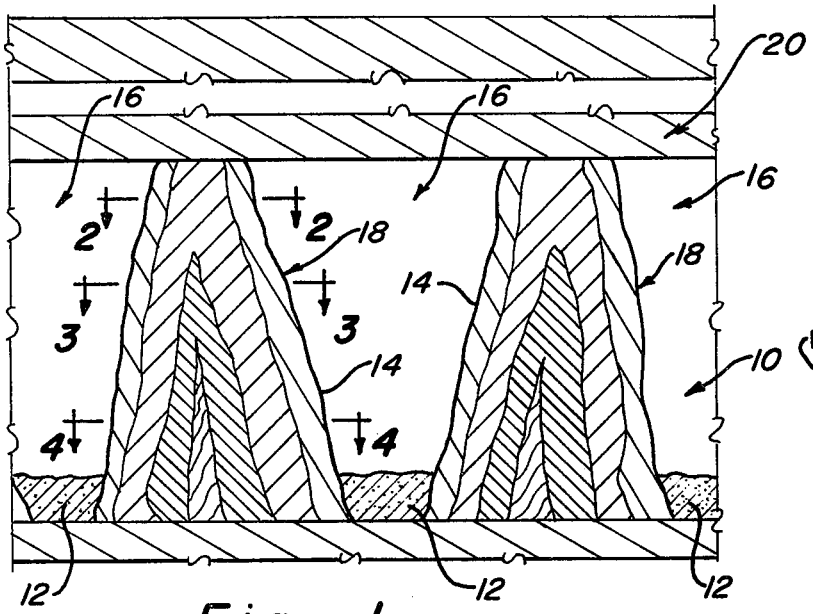
FIG. 1 is a diagrammatic vertical section taken through the earth showing a coal formation as it exists after a coal gasification project and prior to liquefaction according to the method of the present invention.
Figure 2:
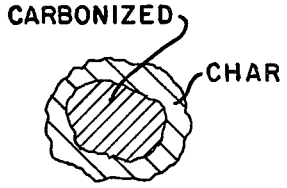
FIG. 2 is a horizontal section taken along line 2—2 of FIG. 1.
Figure 3:
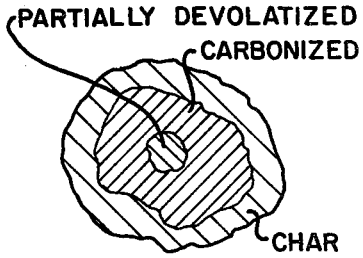
FIG. 3 is a horizontal section taken along line 3—3 of FIG. 1.
Figure 4:
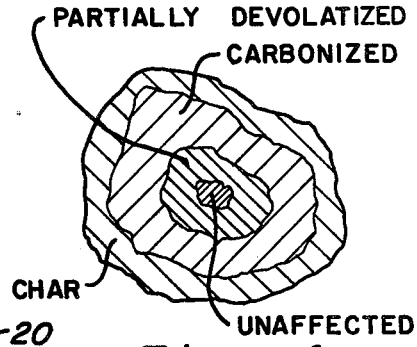
FIG. 4 is a horizontal section taken along line 4—4 of FIG. 1.

Preferably, in accordance with the present invention, the coal formation 10 is partially produced in an in situ gasifcation project. The coal consumed during gasification is removed as gas leaving an ash residue 12 and a substantial amount of coal 14 still in place, for example 50%, as well as significant channels 16 of permeability. The remaining coal 14 is usually in the form of columns 18 which support the overburden 20 as illustrated in FIG. 1. During the gasification of the coal deposit, most of the burning takes place at the top of the formation where the heat is the most intense so that the columns 18 remaining after the gasification is terminated are narrower at the top than at the bottom. Referring to FIGS. 2, 3 and 4, which are sectional views taken progressively downwardly through a typical remaining coal column, it will be appreciated frist by reference to FIG. 2 that near the top of the column the coal 14 is devoid of volatile matter and is in effect composed of an inner core of carbonized coal that has been devolatized by the heat of the nearby fire during the gasification and an outer crust of char. Further down the column as seen in FIG. 3, the column has the same crust of char as near the top of column, has an area inwardly of the char crust which is carbonized, and a small core inside the carbonized coal that has only been partially devolatized during the gasification project. FIG. 4 illustrates the cross sectional composition of the column near the bottom thereof and again can be seen to have a crust of char, an area inwardly of the char which is carbonized, an area inwardly of the carbonized area which has been partially affected by the heat i.e., partially devolatized, and a core or innermost area that is largely unaffected except for a temperature rise.

Presuming that the liquefaction process is performed on a coal formation 10 which has previously undergone gasification, if the liquefaction process is to be started shortly after the gasification process, it will normally be desirable to reduce the temperature of the formation to a temperature at which liquefaction can be carried out in the most efficient and economical manner. Accordingly, after gasification, or as a means of terminating gasification to prevent a runaway burn, an extended cool down period is begun or in other words, a period in which the temperature of the formation is lowered to a point at which the liquefaction can be most efficiently and economically carried out. The formation is cooled by injecting a cooling fluid having a temperature below the prevailing temperature of the formation into the formation. The burning face of the formation during gasification is approximately 3000° F so the cooling fluid should initially have a temperature of less than approximately 2500° F to have a cooling effect on the formation. Of course, if the formation was previously gasified, there will be injection and removal passages 22 and 24 respectively, connecting the surface with the coal formation. If these passages are not present, they will need to be established and will need to include means for hermetically sealing the injection and removal passages so that desired passages can be established and maintained in the formation. Normally, the injection and removal passages will be conventional well bores having hermetically sealed casings 26 and 27 respectively in which tubing 28 and 29 respectively is set and a christmas tree assembly 30 or the like at the surface for controlling the injection of fluids into and removal of fluids from the formation. Also, preferably, the injection and removal passage locations will be spaced along the coal formation so that the injected fluid will pass through the formation before being withdrawn.

As the cooling fluid, such as for example water, is injected into the coal formation, the intense heat of the formation will cause the water to flash to steam. The water is injected into the formation without removal of any of the steam until the formation pressure is brought up to the desired operating pressure, normally in the range of 15 to 1000 psig but preferably about 400 psig. The steam reacts with the hot char and forms synthesis gas ($H_2 + CO$) at temperatures above approximately 1000° F and up to approximately 2000° F. Produced synthesis gas is removed through the removal passage 24 and may be transported by pipe line 32 to a gas clean up facility (not shown) where the hydrogen may be separated and transported by pipe line, for example to an ammonia plant, and the carbon monoxide may be transported by pipe line for example to storage for use as fuel gas. Manufacture of synthesis gas by this method results in slow quenching of the coal in place and gradually reduces the temperature of the formation over a period of months. It is preferably to reduce the temperature in the formation as uniformly as practical. In one form of practicing the invention, there could be numerous wells connecting the surface to the coal formation with each well equipped to be an injector well and a producer well. For reasonably uniform temperature control, each injector well could be operated for a period of time, for example 8 hours, and then be operated as a producer well, for example 8 hours.

Water injection is continued in accordance with the invention until the temperature of the formation 10 is reduced to a temperature normally in the range of 500° F to 1200° F but preferably about 800° F. At this temperature, the quantity of synthesis gas is a relatively small portion of the exit gases. The predominant exit gas at this temperature will be steam. At this point the exit gases are diverted from the gas clean up facilities and may be redirected to an adjacent primary in situ gasification project where the stema can serve as a source of hydrogen and oxygen for the adjacent project.

With the coal formation at the desired temperature, the formation is ready for liquefaction of the coal remaining. It should be noted that during the cool down phase, a considerable amount of the char, see FIGS. 1 through 4, and in some cases all of the char, will be consumed in the reaction with steam to form synthesis gas.

Figure 5:
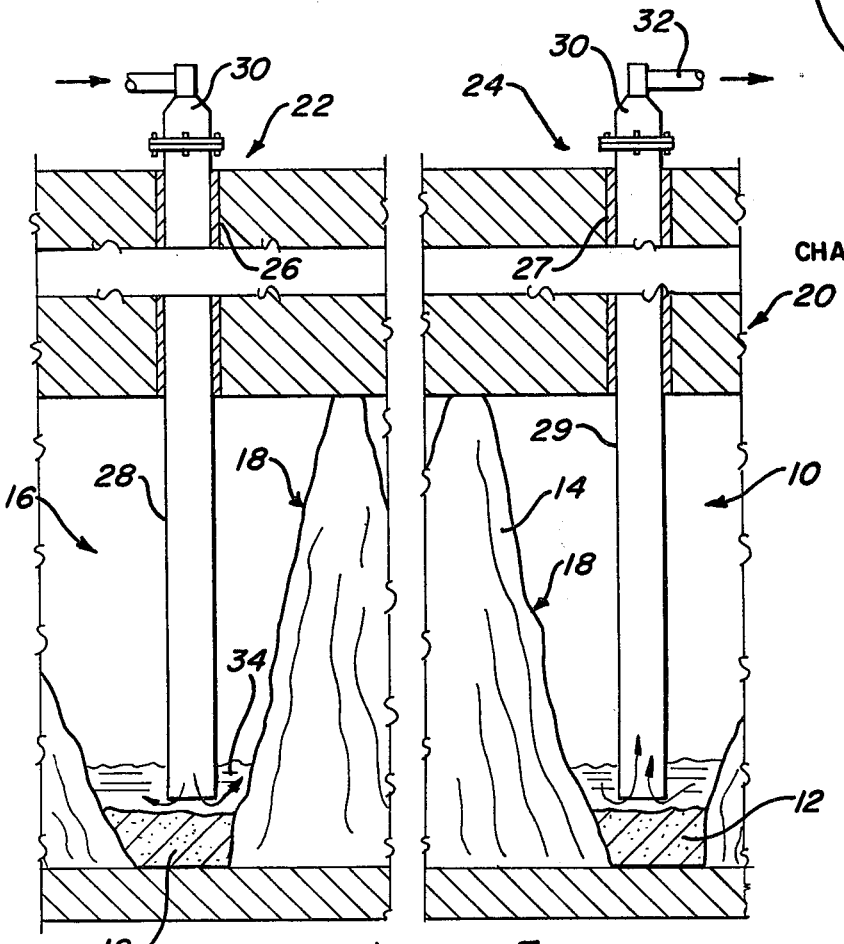
FIG. 5 is a diagrammatic fragmentary vertical section showing the subsurface coal formation of FIG. 1 during the liquefaction method of the present invention.

Liquefaction of the residual coal 14 is begun by bringing the formation 10 up to operating pressure by injecting an inert gas such as nitrogen. As the next step a solvent 34, FIG. 5, known to have the capability of dissolving coal is injected into the formation under pressure to keep the solvent as a liquid at the desired pressure, for example 400 psig, and at process temperature, for example 800° F. The solvent injection line or tubing 28 and fluid production line or tubing 29 are set to a point near the bottom of the formation so that the ends of the lines will be below the liquid level of the solvent 34 in the formation. When the formation has been flooded with the solvent to an appropriate volume of solvent, for example a liquid level about one foot above the bottom of the injector and producer lines, continued injection of solvent is balanced with withdrawals of fluid to maintain formation pressure. Circulation rates are maintained at an appropriate injection rate, for example 420 gallons per minute. In addition to the solvent, synthesis gas may be injected to provide extra hydrogen for hydrogenation of the residual coal as it is taken into solution. Synthesis gas may be obtained from an adjacent primary in situ gasification project and is injected at an appropriate rate, for example 100 standard cubic feet per minute, and an appropriate temperature, for example 800° F. Injection rates for synthesis gas will vary depending upon the type of solvent used and the planned rate for hydrogenation. Excess synthesis gas is separated at the surface and is recovered for further commerical applications.

The injected solvent and synthesis gas are introduced into the formation at a temperature near 800° F so that the formation temperature remains reasonably constant during the liquefaction process. The process begins with the solvent 34 being slowly absorbed into the coal. The coal begins to swell and the depolymerization process progresses, gradually softening the affected coal. The preferred solvent is a hydrogen donor to the process and additional hydrogen is available from injected synthesis gas for reaction with the free radicals generated in depolymerization. The coal thus liquefied has a substantailly higher content of hydrogen than the original coal in place, and thus becomes a true synthetic crude oil. Compared to the original coal which had a heat content of approximately 9000 BTU per pound, the synthetic crude oil derived from the coal will have a heat content of approximately 16,000 BTUs per pound, which in turn compares to a typical crude oil with a heat content of approximately 18,500 BTUs per pound. Further, the ash content of the original coal, being significantly heavier than the liquids, will sink to the bottom with the result that the ash content of the produced synthetic crude oil can be as low as 0.1%. The sulfur content of the original coal, during the liquefaction process readily unites with the available hydrogen to form hydrogen sulfide ($H_2S$) which is separated at the surface and converted into elemental sulfur. The resulting synthetic crude oil can have a sulfur content on the order of 0.2%.

The synthetic will have a heat content of approximately 16,000 BTUs per pound as a result of the selection of the preferred solvent. The synthetic crude will have a pour point on the order of 300° F, which is not a problem if refining facilities are near by. The synthetic crude is quite fluid as it comes out of the ground but rapidly becomes viscous as the temperature is decreased to approach the pour point. Additional heat content may be added and the pour point decreased in the synthetic crude by the use of an alternate solvent, whichis known to have a higher BTU content than coal, although the economics of doing so may not be favorable.

The preferred solvent is an anthracene oil with a boiling point in the range of 525° F to 825° F. This solvent can be obtained from the exit gases produced in a primary project for in situ gasification of coal such as by scrubbing or quenching the exit gases. Other solvents that can be used are phenol, retene, creosote, benzene, phenanthrene, naphthol, tetralin, pyridine, and the like.

As liquefaction proceeds, more and more of the residual coal is affected with a resultant loss of strength for roof support. Weight of the overburden 20 will cause a slow but continuing subsidence, which in turn causes a crusing action on the columns of residual coal, resulting in continuing fragmentation of coal and opening of new cracks. The subsidence of the formation is allowed and encouraged as it provides for a continuous new supply of fresh coal surfaces for reaction with the solvent and exposes more catalysts (contained in the coal) for hydrogenation, e.g., iron compounds, zinc, etc. Further, continuing subsidence reduces the amount of void space within the channels and provides for more intimate contact between the solvent and coal.

Characteristics of the liquefied coal may be controlled underground or above ground or a combination of both. As an example, injection rates for the solvent may be increased resulting in a shorter residence time underground with a result that a small amount of liquefied coal, for example 10% is contained in the return fluid. These produced fluids can be distilled at the surface so that the available solvent is returned to the process underground and the residual sythetic crude oil transferred to above ground storage. On the other extreme, solvent injection may be decreased to the point that resident time underground is lengthened whereby returned fluids are substantially all synthetic crude. Due to the interrelation of solvent efficiencies, temperatures, pressures, catalytic characteristics of the ash, physical characteristics of the coal, efficiencies of hydrogenation, costs of distillation and the like, injection and production rates should be determined by acceptable economic considerations.

As mentioned previously, if a number of wells in the formation area are equipped for injection and production, so that any single well may serve as an injector well or as a producer well, more flexibility in the production plan can be obtained with fluid flow underground directed or redirected for optimum efficiency. It is preferable that the produced synthetic crude be brought to the surface by the established formation pressure, however, if formation pressure is insufficient to lift the crude to the surface, artificial lift equipment may be installed to complete the production cycle.

Although the present invention has been described with a certain degree of particularity, it is understood that the present disclosure has been made by way of example and that changes in details of the process may be made without departing form the spirit thereof.

What is claimed is:

1. A method of in situ production of a preheated coal formation having liquid permeable passages therethrough comprising the steps of:

establishing fluid injection and fluid removal passages connecting the coal formation to a surface location.

gasifying the formation to create an outer layer of char on the coal, injecting water into the formation to react with the char to consume the char, injecting a fluid solvent material into the fomation having the capability of dissolving the coal, dissolving the coal with the solvent material, allowing the formation to subside as the coal is dissolved therein so that more surface area of coal is exposed to the solvent, and removing the admixture of the dissolved coal and solvent from the formation.

2. The method of claim 1 further including the step of injecting synthesis gas ($H_2 + CO$) into the formation to provide extra hydrogen for hydrogenation of the coal as it is taken into solution by the solvent material.

3. The method of claim 2 further including the step of removing unreacted synthesis gas from the solution removed from the coal formation.

4. The method of claim 1 wherein said solvent material is a hydrogen donor.

5. The method of claim 1 further including the step of removing any excess solvent from the solute removed from the coal formation.

6. A method of in situ production of a preheated coal formation having liquid permeable passages therethrough comprising the steps of:

establishing fluid injection and fluid removal passages connecting the coal formation to a surface location, pressurizing the coal formation in the range of 15 to 1000 psig, injecting a fluid solvent material into the formation having the capability of dissolving the coal, dissolving the coal with the solvent material, allowing the formation to subside as the coal is dissolved therein so that more surface area of coal is exposed to the solvent, and removing the admixture of the dissolved coal and solvent from the formation.

7. A method of in situ production of a preheated coal formation having liquid permeable passages therethrough and wherein at least portions of the coal formation initially have a temperature in excess of 2500° Fahrenheit comprising the steps of:

establishing fluid injection and fluid removal passages connecting the coal formation to a surface location, injecting a cooling fluid having a temperature below 2500° Farenheit into the formation, injecting a fluid solvent material into the formation having the capability of dissolving the coal, dissolving the coal with the solvent material, allowing the formation to subside as the coal is dissolved therein so that more surface area of coal is exposed to the solvent, and removing the admixture of the dissolved coal and solvent from the formation.

8. The method of claim 7 wherein said cooling fluid has a temperature below 800° F and is injected into the formation until the temperature of the formation is approximately 800° F.

9. The method of claim 7 wherein said cooling fluid is water which reacts with the coal after being converted to steam to form synthesis gas ($H_2 + CO$).

10. The method of claim 7 wherein the cooling fluid is water and wherein after the formation temperature drops below 1000° F, the resultant superheated stema produced in the formation is captured at the surface.

11. A method of in situ production of a preheated coal formation having liquid permeable passages therethrough and wherein the formation initially has a temperature in excess of 2500° Farenheit comprising the steps of:

establishing fluid injection and fluid removal passages connecting the coal formation to a surface location, pressurizing the coal formation in the range of 15 to 1000 psig, injecting a cooling fluid having a temperature below 2500° Farenheit into the formation, injecting a fluid solvent material into the formation having the capability of dissolving the coal, dissolving the coal with the solvent material, allowing the formation to subside as the coal is dissolved therein so that more surface area of coal is exposed to the solvent, and removing the admixture of the dissolved coal and solvent from the formation.

* * * * *

UNITED STATES PATENT AND TRADEMARK OFFICE

CERTIFICATE OF CORRECTION

PATENT NO. : 3,948,320

DATED : April 6, 1976

INVENTOR(S) : RUEL C. TERRY

It is certified that error appears in the above-identified patent and that said Letters Patent are hereby corrected as shown below:

Column 2, line 7, "raplaced" should be --replaced --;
Column 3, line 30 "applicants's" should be --applicant's--;
Column 4, line 35, "approximately" should be --approximating--;
Column 5, line 44 "800°f" should be --800°F--;
line 45 "F," should be --consumed--;
Column 6, line 14 "whch" should be --which--;

line 53, "frist" should be --first--;
line 60, after "top of" insert --the--;
Column 7, line 29, "passages" (second occurrence) should be --pressures--
line 60, "preferably" should read --preferable--;
Column 8, line 10, "stema" should be --steam--;
Column 9, line 36, "crusing" should be "crushing";

Column 11, line 21, "stema" should be --steam--;

Signed and Sealed this

Third Day of August 1976

[SEAL]

*Attest:*

RUTH C. MASON
*Attesting Officer*

C. MARSHALL DANN
*Commissioner of Patents and Trademarks*